US011000114B2

(12) United States Patent
Agha

(10) Patent No.: US 11,000,114 B2
(45) Date of Patent: May 11, 2021

(54) LOCKABLE HOLDER AND REPLACEABLE CLEANING HEAD

(71) Applicant: Nasr Said Agha, North York (CA)

(72) Inventor: Nasr Said Agha, North York (CA)

( * ) Notice: Subject to any disclaimer, the term of this patent is extended or adjusted under 35 U.S.C. 154(b) by 89 days.

(21) Appl. No.: 16/294,643

(22) Filed: Mar. 6, 2019

(65) Prior Publication Data

US 2020/0281344 A1 Sep. 10, 2020

(51) Int. Cl.
*A46B 5/00* (2006.01)
*A47K 7/02* (2006.01)

(52) U.S. Cl.
CPC ..... *A46B 5/0095* (2013.01); *A46B 2200/304* (2013.01)

(58) Field of Classification Search
CPC ..... A46B 5/0095; A46B 7/048; A46B 7/044; A46B 2200/304; A46B 9/005; A46B 5/0041; A47L 17/04; A47L 17/08; A47L 13/022; A47L 13/46; A47K 7/022; A47K 7/028
USPC ..... 15/147.1, 147.2, 150, 229.11, 229.13, 15/244.1, 244.2
See application file for complete search history.

(56) References Cited

U.S. PATENT DOCUMENTS 1,268,769 A * 6/1918 Poole ..... A47L 13/46 15/151
1,551,804 A * 9/1925 Dalton ..... A47L 13/46 15/153
2,191,642 A * 2/1940 Carvalho ..... A47K 7/028 401/201
2,900,652 A * 8/1959 Kautenberg ..... A47L 13/46 15/153
2002/0148061 A1* 10/2002 Tanaka ..... A47L 13/38 15/229.3
2010/0175211 A1* 7/2010 Hu ..... A47L 13/24 15/150

* cited by examiner

*Primary Examiner* — Daniel J Colilla

(57) ABSTRACT

This disclosure provides cleaning implement comprising a holder and a removable cleaning head. The cleaning head may be of various types, including brushes, sponges, dusters, and loofahs. The holder has two arms connected at a junction. Opposite the junction, the holder includes a locking mechanism. In one embodiment, the locking mechanism includes a hingedly connected locking member on the first arm, which includes a latch portion which engages a catch disposed on the second arm. In another embodiment, the locking mechanism includes a hingedly connected locking member on each arm, which interlock when moved to a locking position. The arms may be flexible so that they can be pushed toward each other to facilitate the coupling and decoupling of the locking mechanism.

8 Claims, 17 Drawing Sheets

LOCKABLE HOLDER AND REPLACEABLE CLEANING HEAD

TECHNICAL FIELD

This disclosure relates in general to lockable holders, and in particular to cleaning implements with replaceable cleaning heads.

BACKGROUND

There are many applications in which it may be desirable to provide a cleaning implement with a replaceable head. Likewise, cleaning implements such as dish brushes, dusters, and the like may become soiled, wear out their cleaning heads, or otherwise be in need of disposal despite the handle being in good condition.

It may also be desirable in some applications to provide a cleaning implement with an integrated dispenser for cleaning agents, detergents, body washes and the like. Such integrated dispensers increase the cost of manufacturing a cleaning implement, particularly if they cannot be re-used when the cleaning head has reached the end of its life or is otherwise in need of replacement.

One particular application is in bathing. It is often difficult for people to wash their own backs. Many devices have been developed to resolve this issue. For example, loofahs, bristles, or sponges disposed on long handles can be used to wash one's own back when bathing.

However, conventional loofahs, bristles, or sponges are often permanently affixed to handles by adhesives or other permanent means. This type of attachment leaves nooks and crevices between different, materials, which can foster harmful bacterial growth. In addition, when the loofahs, bristles, or sponges need to be replaced, the handle must be replaced as well, resulting in waste of materials.

SUMMARY

This specification relates to a holder that removably holds a cleaning head. The cleaning head may be of various types, including brushes and spongy materials for cleaning or loofahs used to scrub one's back. The cleaning head can be easily removed from the holder to permit the cleaning head to be used independent of the holder, or to be dried when not in use, disposed of when soiled, or replaced when it becomes worn down. A pair of arms on the holder are inserted into the cleaning head and joined by a locking mechanism. In some embodiments, the holder includes one or more internal cavities in communication with dispensing apertures in the arms for dispensing detergents and other cleaning fluids.

In one broad aspect, the specification relates to a holder having first and second arms connected at a junction. The first arm comprises a first end opposite the junction. The second arm comprises a second end opposite the junction. The first and second ends are spaced apart from one another. A locking mechanism is provided for joining the first and second ends when moved from an unlocked position to a locked position.

The locking mechanism has a first locking member hingedly connected to the first end for movement between the locked position and the unlocked position and a receiving portion on the second end, for receiving and holding the first locking member when the in the locked position.

In an embodiment, the receiving portion is a catch disposed on the second end, for receiving a latch portion of the first locking member when the locking mechanism is in the locked position.

In another embodiment, the receiving portion is a second locking member hingedly connected to the second end, wherein the first and second locking members have a complementary profile, so as to interlock when the locking mechanism is in the locked position. The first and second locking members may rotate toward one another when entering the locked position. In some embodiments, the complementary profile is a lug on the first locking member which engages a corresponding recess on the second locking member. The complementary profile may also in some cases be identical.

The locking mechanism may be biased toward an unlocked position. In some embodiments, the locking member may be parallel to the first arm when in the unlocked position. The bias may be a spring, such as a flat spring joining the first arm to the first locking member.

The locking members may be integrally formed with the first or second arms of the holders. In such embodiments, a web of resilient material may serve as the hinge. Alternatively, the hinge may be of a more conventional type.

The holder may further include a handle, which may be connected at the junction. In some embodiments, the handle defines a handle cavity and at least one arm has a cavity in fluid communication with the handle cavity. Dispensing apertures may be included to dispense detergents or other cleaning fluids from the handle and into the cleaning head. In some embodiments, a dispenser is provided in the handle cavity to dispense the cleaning solution.

The arms of the holder may be parallel or they may diverge, at a slight angle (e.g. less than 5 degrees). In some embodiments, the arms must be squeezed together to lock or unlock the holder. The arms may also in some cases be of adjustable length.

In another broad aspect, the present disclosure provides a cleaning head which defines a first aperture for receiving a first arm of the holder and a second aperture for receiving the second arm of the holder. The first and second aperture may be sized to match the length of the first and second arms of the holder. A channel may also be included between the first and second aperture, for receiving the locking member(s) of the holder. The channel may be internal to the cleaning head or open to the exterior of the cleaning head for easier access. The channel may be formed to guide the locking mechanism toward the locked position.

The cleaning head may be of various types, including brushes, sponges, dusters, scrubbers and the like. The cleaning head may be made of natural or synthetic materials. In one embodiment, the cleaning head is a loofah.

In another broad aspect, the present disclosure provides a cleaning implement comprised of a holder as described above and a cleaning head as described above.

In another broad aspect, the present disclosure provides a method of assembling, a cleaning implement. The method includes the steps of: inserting first and second arms of a holder into a first and second cavity in a cleaning head; moving a first locking member on the first arm to a locked position; and engaging the first locking member with a receiving portion operably coupled to the second arm, to receive and hold the first locking member in the locked position. The method may further comprise squeezing the first and second arms toward each other before moving the first locking member to the locked position.

In one embodiment, the receiving portion is a catch disposed on the second end, for receiving a latch portion of the first locking member when the locking mechanism is in the locked position.

In another embodiment, the receiving portion is a second locking member hingedly connected to the second end, wherein the first and second locking members have a complementary profile, so as to interlock when the locking mechanism is in the locked position.

In another broad aspect, the present disclosure provides a method of replacing a cleaning head on an implement. The method includes the steps of: moving a locking mechanism on a holder from a locked position to an unlocked position; and withdrawing a first arm and a second arm of the holder from a first aperture and a second aperture on the cleaning head. The locking mechanism has: a first locking member hingedly connected to the first end for movement between the locked position and the unlocked position; and a receiving portion operably coupled to the second end, for receiving and holding the first locking member when the in the locked position. The method may further comprise squeezing the first and second arms toward each other before moving the first locking member to the locked position.

BRIEF DESCRIPTION OF THE DRAWINGS

Reference will now be made, by way of example, to the accompanying drawings which show example embodiments of the present application, and in which.

DESCRIPTION

With reference to the above drawings, various examples will now be disclosed which illustrate, by way of example only, various embodiments of the invention contemplated herein. Although the present disclosure provides examples, the disclosed methods and devices may be suitable for other purposes, with modification as appropriate.

Figure 1:
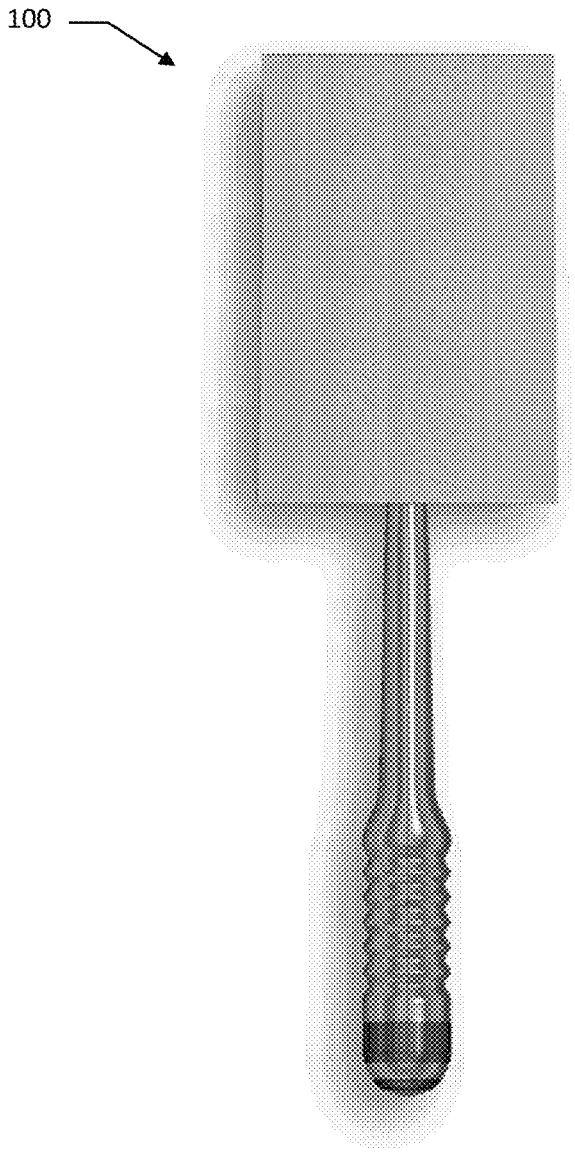
FIG. 1 is a top plan view of a cleaning implement according to an embodiment of the invention.
Figure 2:
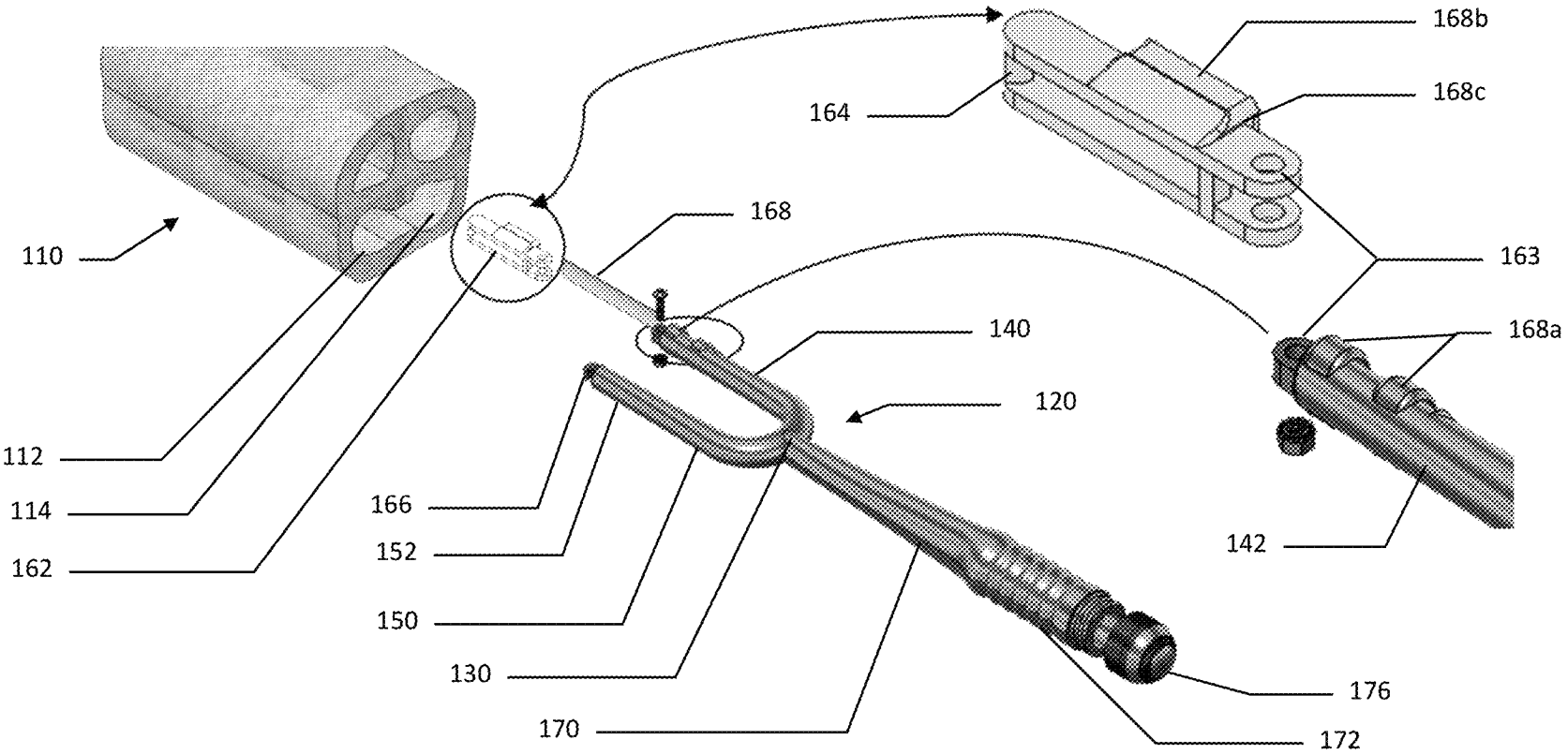
FIG. 2 is an exploded isometric view of the cleaning implement in FIG. 1, including enlargements of the whole locking arrangement.
Figure 3:
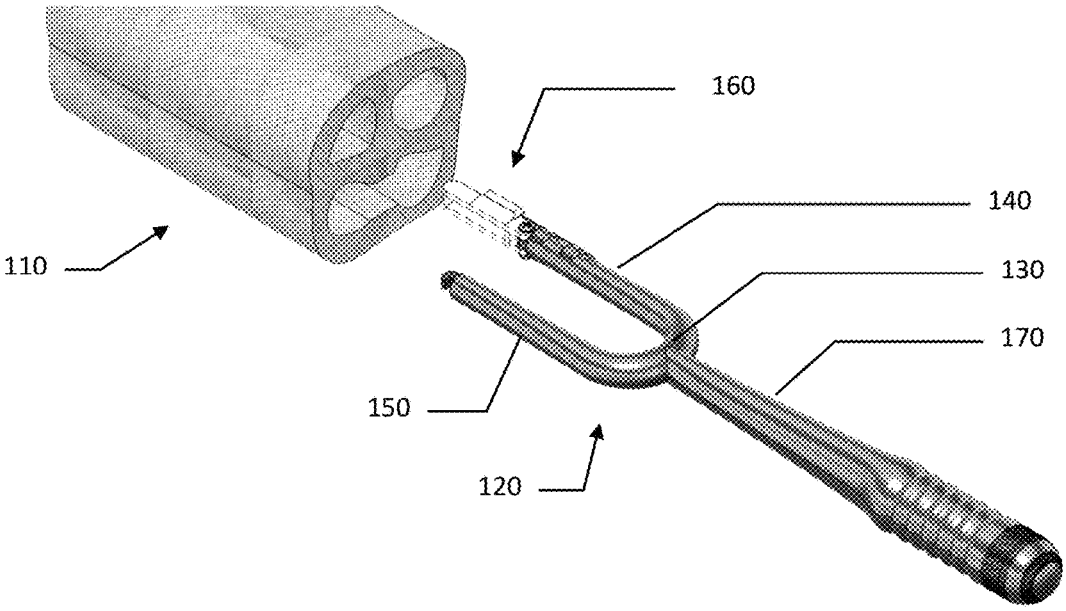
FIG. 3 is a perspective view of the holder in FIG. 2 being inserted into a cleaning head according to an embodiment of the present invention.

FIGS. 1 to 3 show a cleaning implement 100 according to an embodiment disclosed herein, which is designed to assist the user in washing their back. As best seen in FIG. 3, the implement 100 is generally comprised of a cleaning head 110 (in this example, a loofah) and a holder 120.

Figure 4:
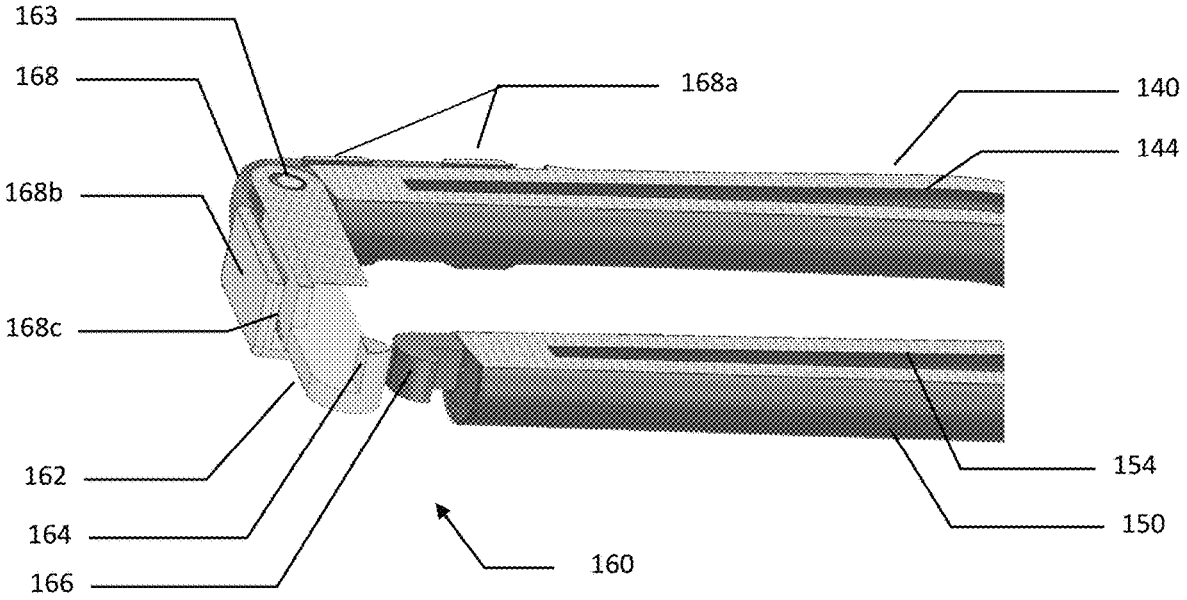
FIG. 4 is an enlarged sectional view of the locking mechanism of the holder in FIG. 2.
Figure 5:
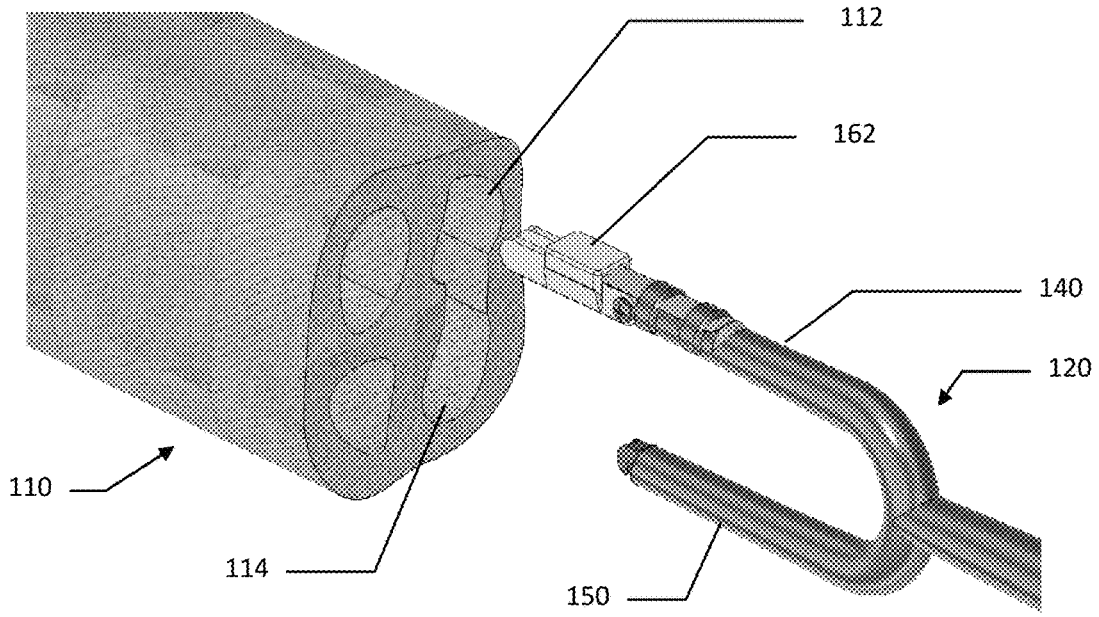
FIG. 5 is a perspective view of the holder in FIG. 2 from a different angle.
Figure 6:
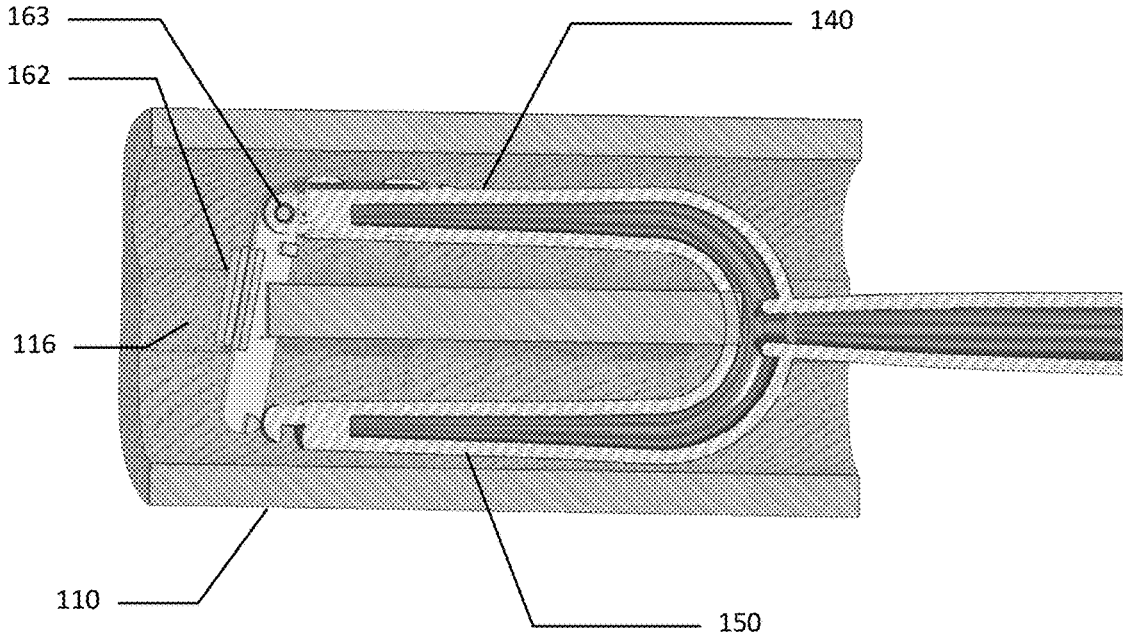
FIG. 6 is a cross-sectional view of the cleaning holder of FIG. 2, after insertion into the cleaning head, wherein the locking member is being moved to the locked position.

FIGS. 2-4 show the holder 120 in further detail. As seen therein, a first arm 140 and second arm 150 are connected at a junction 130. In this embodiment, the arms 140, 150 and junction 130 form a U-shaped configuration. Opposite the junction 130 are the first end 142 and second end 152 of the first arm 140 and second arm 150, respectively. The first end 142 of the holder 120 has a locking mechanism 160, which joins the first arm 140 to the second arm 150 when the holder 120 is inserted into the cleaning head 110.

Figure 30:
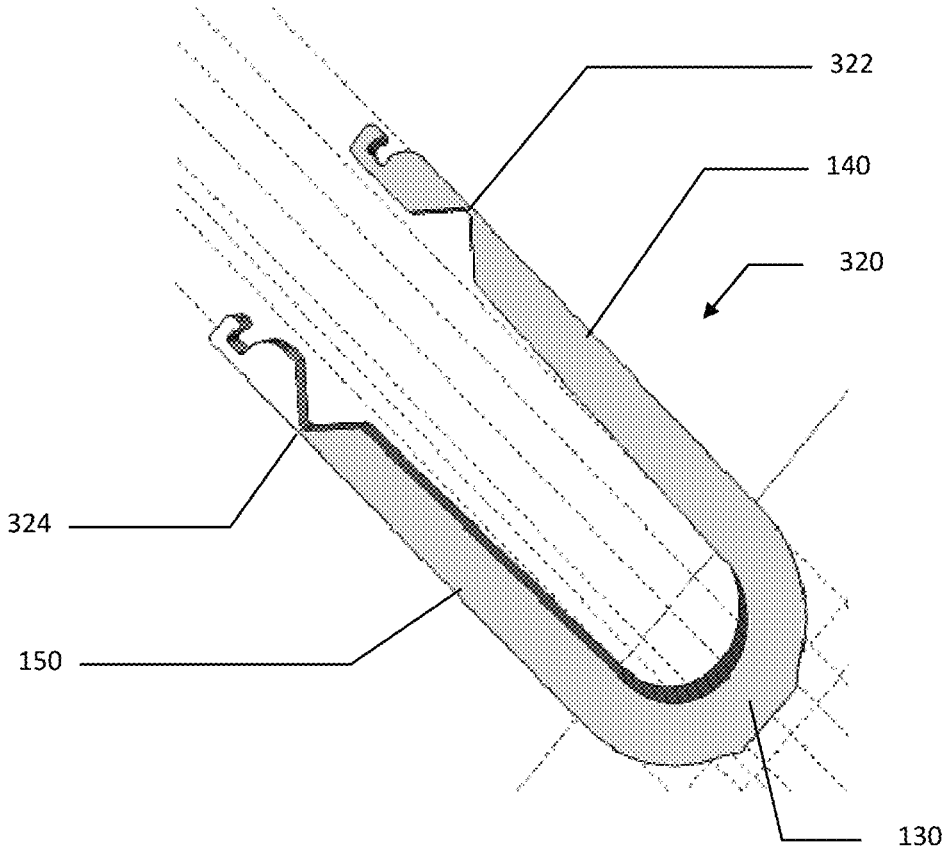
FIG. 30 is a further embodiment of the present invention, wherein the hinge portion joining the locking member to the arm is a thin web of material.

In the embodiment shown in FIGS. 1-4, the locking mechanism 160 includes a locking member 162 attached to the first end 142 of the first arm 140 by a hinge portion 163. Stainless steel pins or barrel screw fasteners may operate as the axis for the hinge 163. As discussed further below, various other hinge arrangements are also contemplated (see for e.g. FIG. 30).

Figure 7:
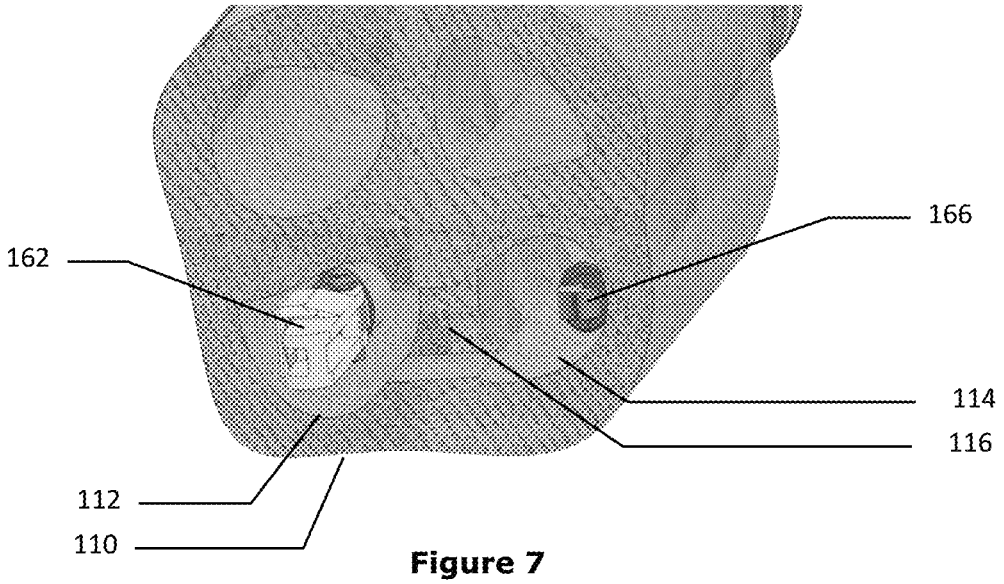
FIG. 7 is a perspective end view of the holder of FIG. 2, after insertion into the cleaning head, with the locking member in the unlocked position.
Figure 8:
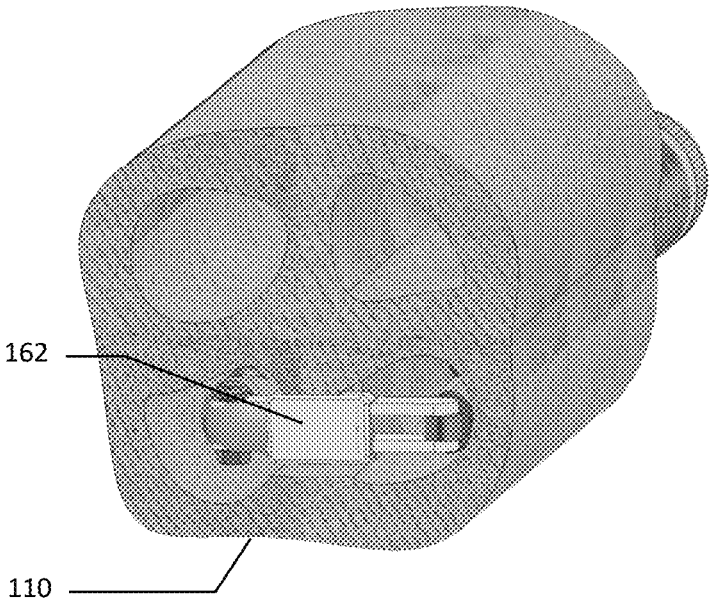
FIG. 8 is a perspective end view of the holder of FIG. 2, after insertion into the cleaning head, with the locking member in the locked position.

Rotation of the locking member 162 about the hinge 163 allows for movement of the locking mechanism 160 between the unlocked position (FIG. 7) and the position (FIG. 8).

The locking member 162 may pivot freely about the first end 142 or a bias may be applied to urge the locking member 162 toward the unlocked position. In the example shown in FIGS. 1-4, a bias is provided by a flat spring 168, which urges the locking member 162 to the unlocked position. As seen in FIG. 4, the flat spring 168 is anchored to the first end 142 using jackets 168*a* and is anchored to the locking member 162 at a slot 168*c* disposed in an anchor portion 168*b*. Rotation of the locking member 162 to the locked position is resisted by the spring 168. When no force is applied to the locking mechanism 160, the flat spring 168 aligns the locking member 162 with the first arm 140 to assist in the insertion process. Other suitable arrangements, such as coil springs and the like, are also contemplated.

FIGS. 10-13 depict the locking and unlocking sequence for the locking mechanism 160 used in embodiment shown in FIGS. 1-4.

The locking mechanism 160 can be moved to the locked position by depressing the locking member 162. In the embodiment shown in FIGS. 10-11, the anchor portion 168*b* serves as a convenient location for the user to depress the locking member 162.

Depressing the locking member 162 causes movement of a latch portion 164 of the locking, member beyond a catch 166 located on the second end 152 of the second arm. In the example provided in FIG. 10, the second arm 150 is made of a resilient material and deflects toward the first arm 140 when the locking member 162 is depressed, to facilitate the latching action. Alternatively, or in addition, the user may squeeze the arms 140, 150 toward one another to assist the movement of the latch portion 164 into the catch 166. In other embodiments, the locking member 162 may be constructed from a resilient material, to facilitate the latching action. The locking member 162 then snaps into position after entering the locked position (see: FIG. 11).

In some embodiments, the arms 140, 150 can be squeezed together to assist the user in moving the locking member 162 to the unlocked position. This is shown in FIG. 12, in which the arms 140 and 150 have been deflected toward one another to permit the latch portion 164 on the locking member 162 to release the catch 166 on the second arm 150.

In some embodiments the holding force of the locking mechanism 160 may be enhanced by having the arms 140, 150 diverge at a slight angle. In such embodiments, squeezing, the arms 140, 150 together may be necessary to move the locking member 162 to the locked position. In order to avoid difficulties when installing the cleaning head 10, the angle may in some cases be slight (e.g. less than 5 degrees). When the locking mechanism 160 is in in the locked position, the resulting spring force imparted by the diverging arms 140, 150 may provide a more secure connection at the locking mechanism 160.

Figure 12:
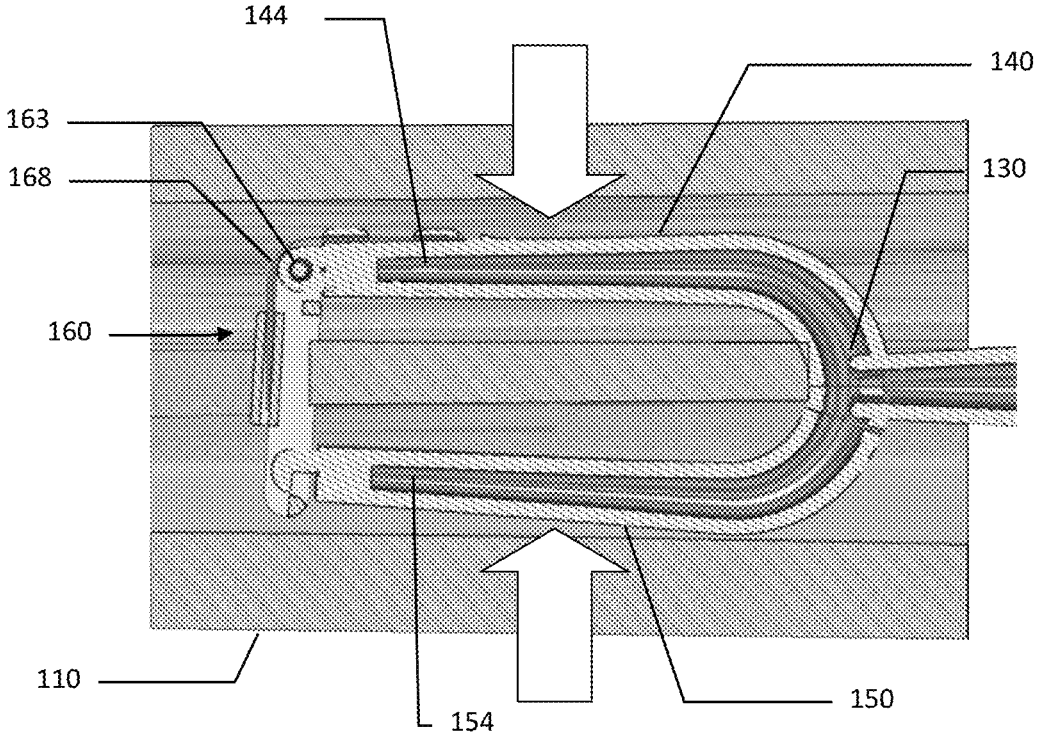
FIG. 12 is an enlarged cross-sectional view of the holder of FIG. 9, after insertion into the cleaning head, wherein the first and second arms are squeezed together, to permit the latch portion of the locking member to release the catch.
Figure 13:
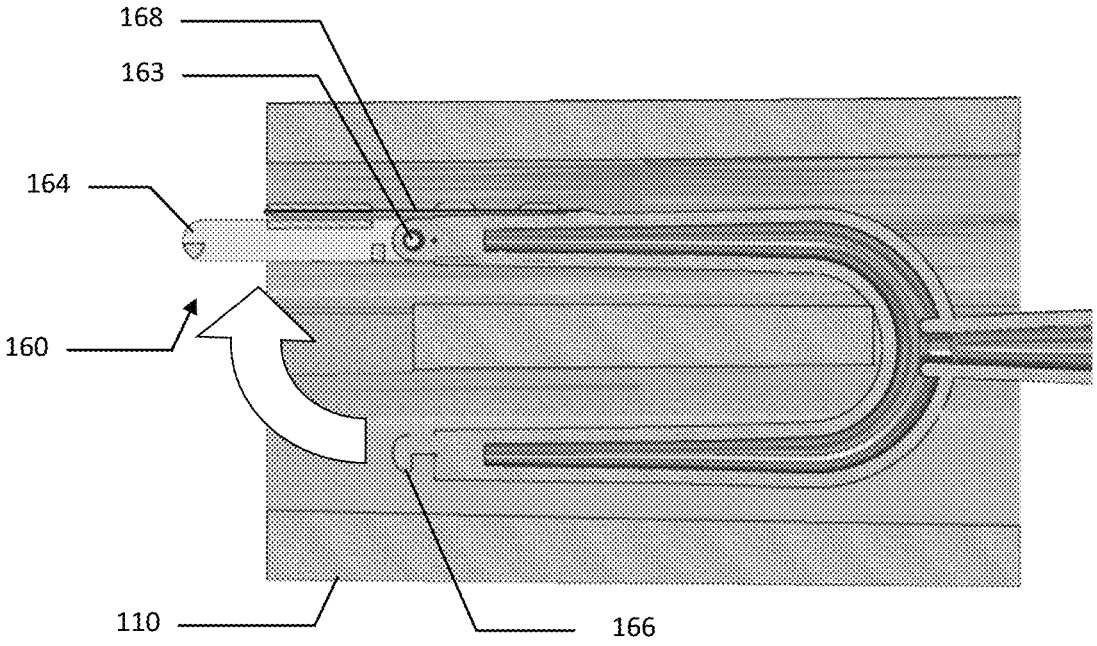
FIG. 13 is an enlarged cross-sectional view of the holder of FIG. 9, after insertion into the cleaning head, wherein the locking member has returned to the unlocked position.
Figure 14:
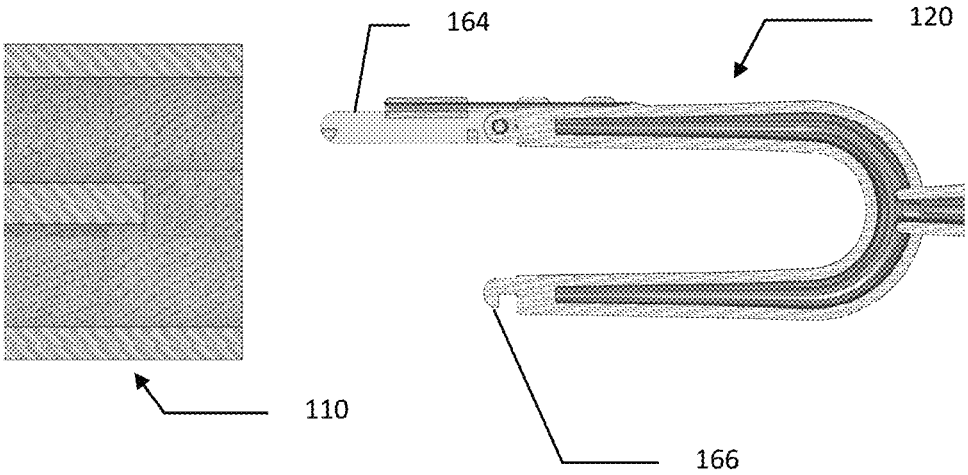
FIG. 14 is an enlarged cross-sectional view of the holder of FIG. 9, wherein the holder is being withdrawn from the cleaning head.

As seen in FIGS. 12-13, where the locking member 162 is also biased toward the unlocked position and the arms 140, 150 are made of a resilient material, squeezing the arms 140, 150 may also cause the locking mechanism 160 to automatically return to the unlocked position. This may be advantageous in assisting the user in withdrawing the holder 120 from the cleaning head 110 (see: FIG. 14).

In some embodiments, the holder 120 also includes a handle 170. The handle 170, may include a grip portion 172 to assist the user in grasping the cleaning implement 100. In the embodiment shown in FIG. 3, the handle 170 is connected at the junction 130 and the grip portion 172 is a ribbed portion. Other textured surfaces may also be used, include serrations (see for e.g. FIG. 18).

In other embodiments, the handle 170, may be directly attached to either or both arms 140, 150 of the holder 120, rather than at the junction. A hole, strap, or other means may also be provided in the handle 170 to assist the user in hanging the cleaning implement 100 when not in use.

The handle 170 may be of solid construction for increased strength or it may be hollow to reduce weight and/or to permit the user to dispense a cleaning agent from within.

Figure 15:
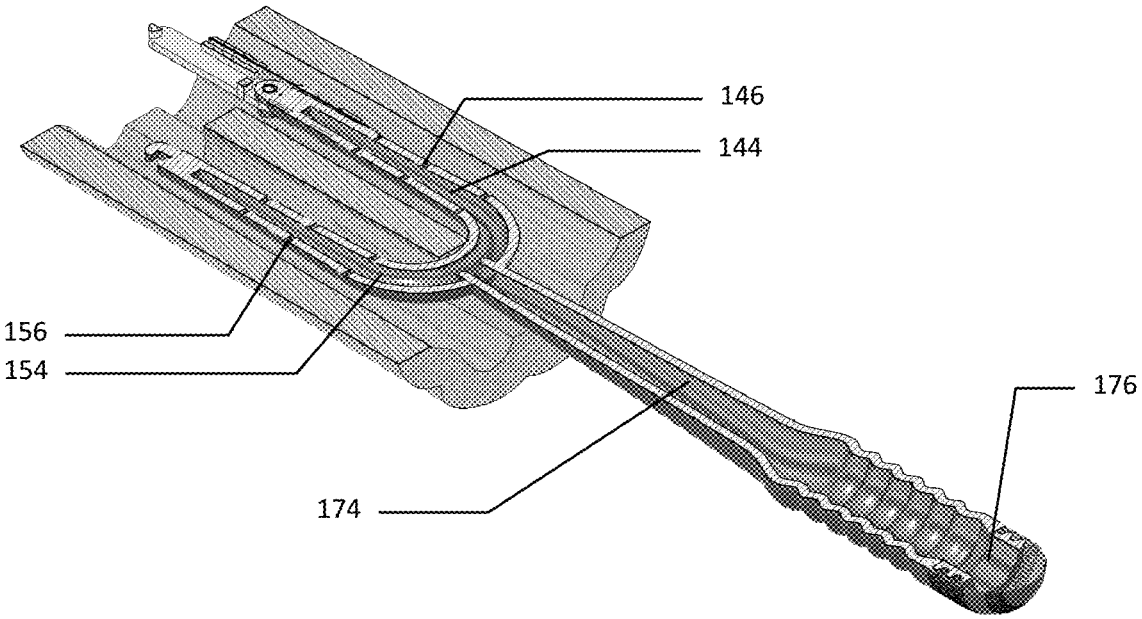
FIG. 15 is an alternative embodiment of the present invention, wherein the handle cavities include dispensing apertures.
Figure 16:
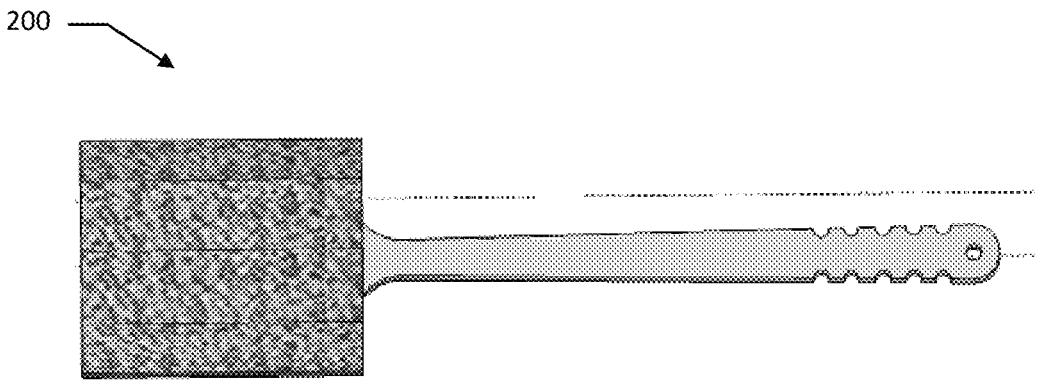
FIG. 16 is a top plan view of a cleaning implement according to a further embodiment of the invention.
Figure 17:
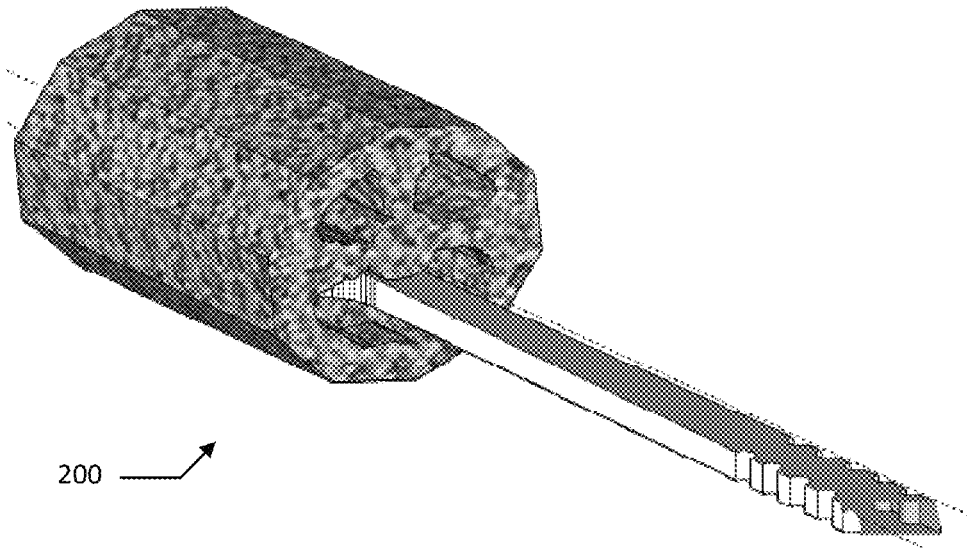
FIG. 17 is a perspective view of cleaning implement of FIG. 16.

For example, as seen in FIG. 15, one or both of the arms 140, 150 of the holder may include one or more dispensing apertures 146, 156 which are in fluid communication with an internal cavity 144, 154 within the arm 140, 150. The arm cavities 144, 154 may in turn be in communication with a hollow portion of the handle 170 which defines a handle cavity 174. The handle cavity 174 may be directly filled with the cleaning agent, or a dispenser (not shown) may be provided in handle cavity 174 for controlling the release of the cleaning agent into the arm cavities. A cap 176 may also be included to provide access to the handle cavity 174, which in this example is threaded to the body of the handle 170. The cleaning solution may be of various types, including body wash, dishwashing liquid, tile cleaner, or other cleaning agents as called for by the application for the cleaning implement 100.

The cleaning head 110 may be of various types, depending on the intended application for the cleaning implement 100. In the example provided in FIGS. 1-4, the cleaning head 110 is a loofah sponge intended for use in the shower. Synthetic materials may also be substituted for the loofah. Other types of cleaning head 110 are also contemplated, such as brush heads (including natural, synthetic, and wire brushes), natural and artificial sponges (including pot scrubbers and the like), feather and synthetic dusters, or other suitable heads for a cleaning implement designed for a particular application.

The cleaning head 110 includes a first aperture 112 and a second aperture 114, into which the first and second arms 140, 150 of the holder 120 are respectively inserted.

In some embodiments, the arms 140, 150 may extend beyond the cleaning head 110 after insertion, which would permit the locking mechanism 160 to be moved to the locked position.

Figure 9:
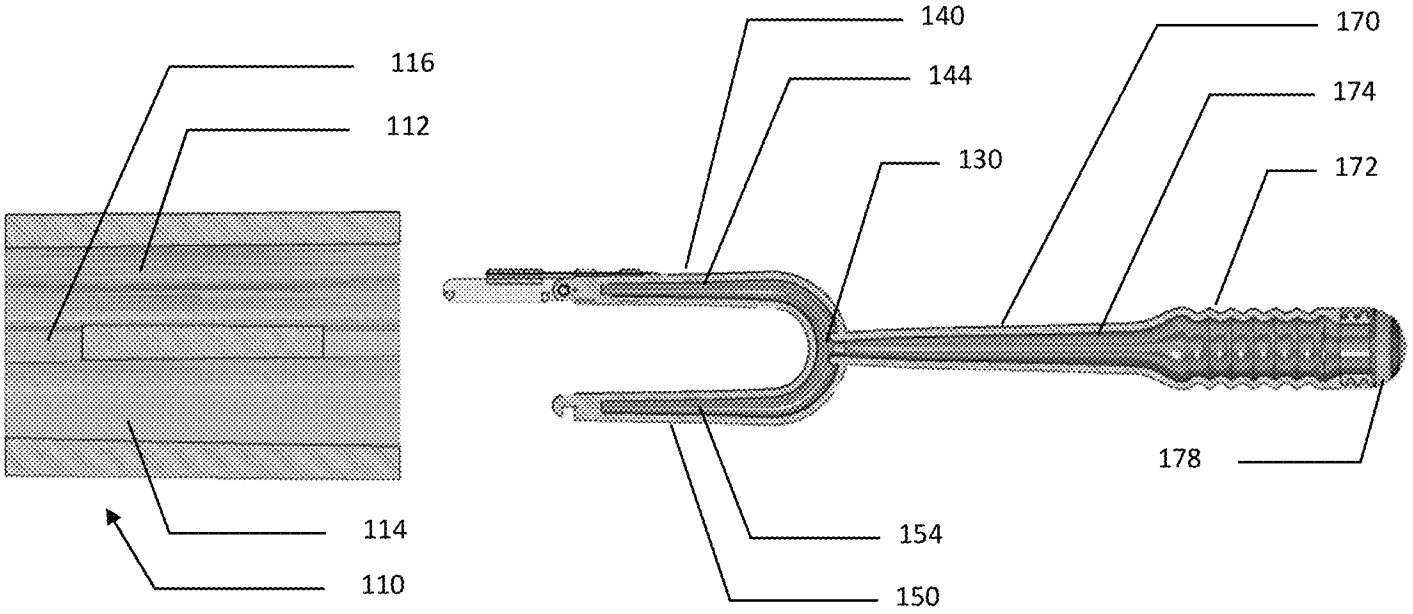
FIG. 9 is a cross-sectional view of the cleaning head and holder of FIG. 2.

In other embodiments, such as the one shown in FIG. 9, the cleaning head 110 includes a channel 116 that permits the locking member 162 to enter the locked configuration, without exposing the holder 120 to the surface being cleaned by the cleaning head 110. The channel 116 may be located within the cleaning head 110 or, as seen in FIG. 9, the channel 116 may be open to the exterior of the cleaning head 110 for easy access by the user. Where the channel 116 is internal, the channel 116 may be configured to guide the locking mechanism 160 toward the locked position.

Figure 10:
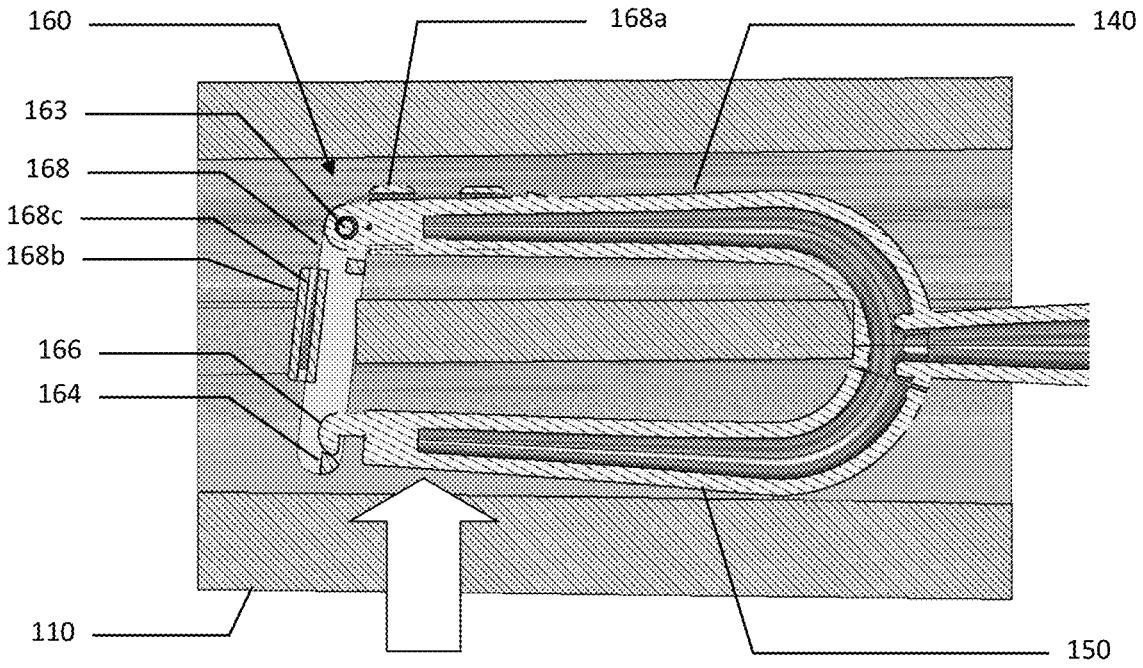
FIG. 10 is an enlarged cross-sectional view of the holder of FIG. 9, after insertion into the cleaning head, wherein the second arm is deflected to permit the latch portion of the locking member to engage the catch on the second arm.
Figure 11:
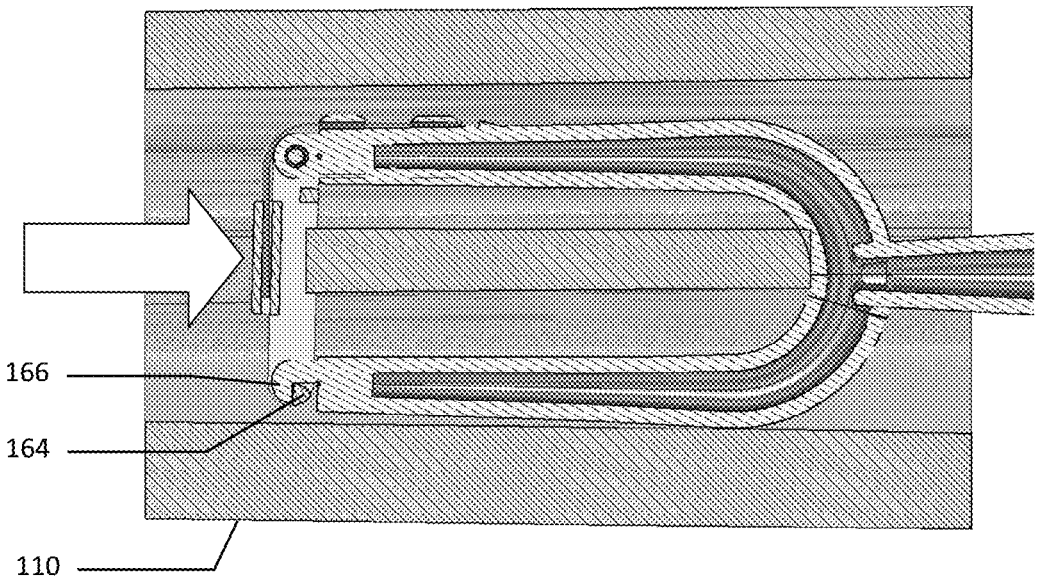
FIG. 11 is an enlarged cross-sectional view of the holder of FIG. 9, after insertion into the cleaning head, wherein the locking member has been pressed into the locked position.

FIGS. 9 to 14 illustrate the process for attaching (FIGS. 9-11) and removing (FIGS. 12-14) a cleaning, head 110 from the holder 120. Turning to FIG. 9, the locking element 162 of the holder 120 is moved into an unlocked position and is preferably aligned with the arms 140, 150 of the holder 120 prior to insertion. In embodiments where the member 162 is biased toward an unlocked position, the bias may assist in this process. As seen in FIG. 9, the arms 140, 150 and locking member 162 are aligned with the apertures 112, 114 in the cleaning head 110 and are inserted therein. As shown in FIGS. 10 and 11, the locking mechanism 160 is moved to the locked position, in the manner described above, to retain the cleaning head 110 on the holder 120.

The process for removing the cleaning head 110 proceeds in the opposite manner. The locking mechanism 160 is moved from the locked position (FIG. 8) to the unlocked position (FIG. 7), in the manner described above, and the arms 140, 150 are withdrawn from the apertures 112, 114 in the cleaning head 110 (FIG. 14).

In the embodiment shown in FIGS. 7 and 13, the locking member 162 partially protrudes from the cleaning head 110, due to the open nature of the channel 116. This provides the user easier access when locking or unlocking the locking mechanism 160.

FIGS. 16 to 29 provide another embodiment of a cleaning implement 200 according to the present disclosure. Similar to the previous cleaning implement 100, the cleaning implement 200 in this alternative embodiment also has a holder 120 for releaseably attaching a cleaning head 110. The holder 120 has a first arm 140 and a second arm 150 which meet at a junction 130. A handle 170 also extends from the junction 130 for grasping by the user. However, in this embodiment 200 the locking mechanism 260 includes first and second locking members 262, 264 that pivot toward one another and interlock when in the locked position.

Figure 18:
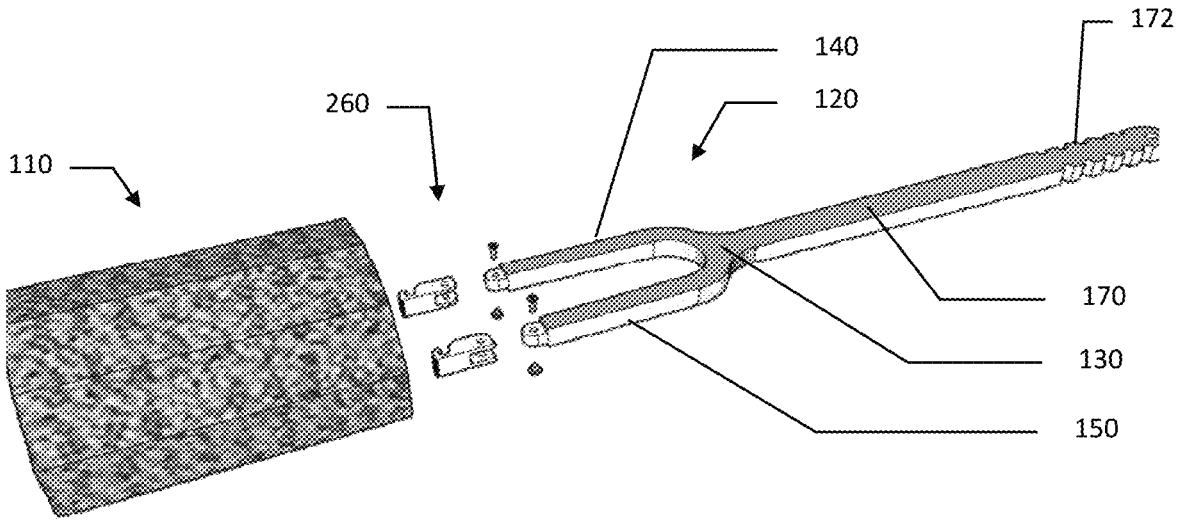
FIG. 18 is an exploded isometric view of the cleaning implement in FIG. 16, showing the cleaning head, locking members, and holder.
Figure 19:
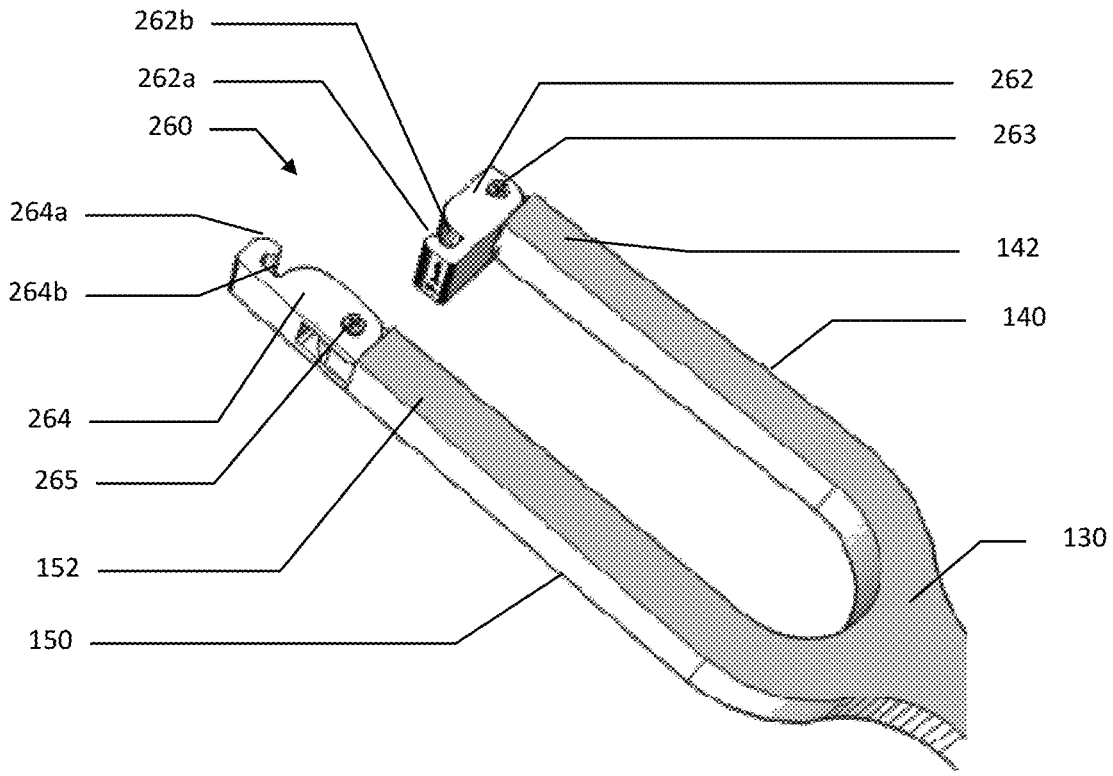
FIG. 19 is an enlarged perspective view of the first and second arms of the holder in FIG. 18.

As seen in FIGS. 18-19, each end 142, 152 of the arms 140, 150 has a locking member 262, 264 hingedly attached thereto. In the example shown in FIG. 19, the locking members 262, 265 are attached using hinges 263, 265, which permit the locking members 262, 264 to pivot toward one another. Stainless steel pins or barrel screw fasteners may operate as the axis for the hinges 263, 265. In this example, rounded and square corners on the locking members 262, 264 also limit the range of motion to 90 degrees, to assist the user in aligning the members 262, 264 with the arms 21, 22 when inserting the holder 120 into the cleaning head 110.

Various other hinge arrangements are also contemplated. For example, and without limitation, thin webs 322, 324 of resilient material may be used in place of the hinges 263, 265 to join the locking members 262, 264 to the holder 120. An example is provided in FIG. 30. This configuration allows for the unitary manufacture of the arms 140, 150 and the locking members 262, 264. The plastic chosen must balance the necessary flexibility of the thin webs 322, 324 with the need for rigidity in the holder 120. A similar arrangement may be adapted for the hinge 163 in the locking mechanism 160 of the cleaning implement 100 show in FIG. 4.

The locking members 262, 264 may pivot freely about the ends 142, 152 or a bias may urge the members 262, 264 toward the unlocked position. For example, the hinges 263, 265 in FIG. 19 may be biased by a spring (not shown) toward the unlocked position, which as discussed above, may assist the user when inserting the holder 120 into the cleaning head 110.

Figure 20:
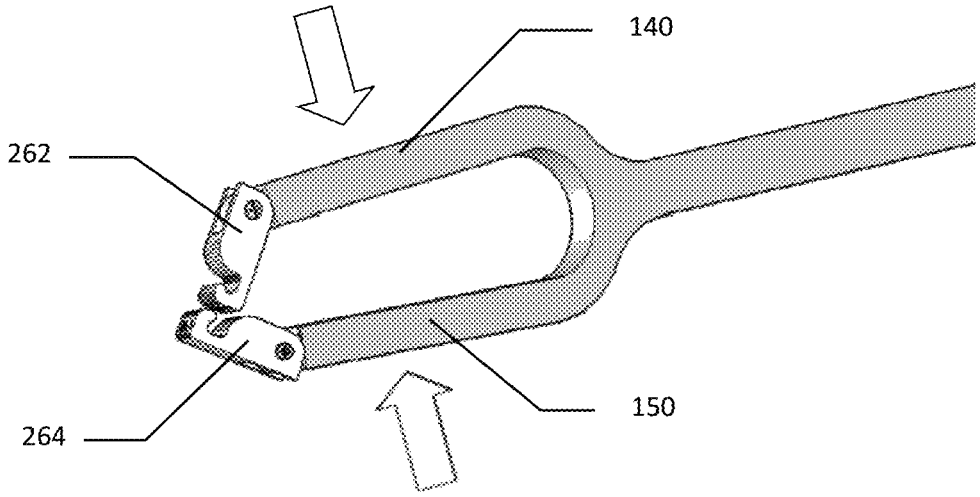
FIG. 20 is a perspective view of the holder of FIG. 18, wherein the first and second arms have been squeezed toward one another, to facilitate movement of the locking mechanism.
Figure 21:
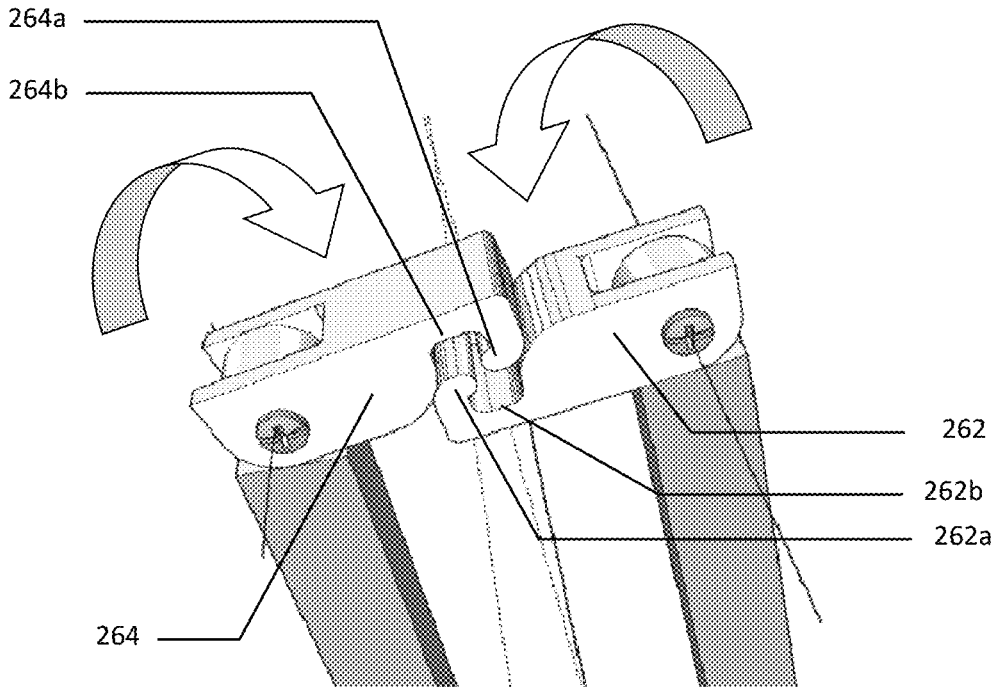
FIG. 21 is an enlarged perspective view of the first and second locking members of the holder of FIG. 18, showing the rotation thereof into the locked position.
Figure 22:
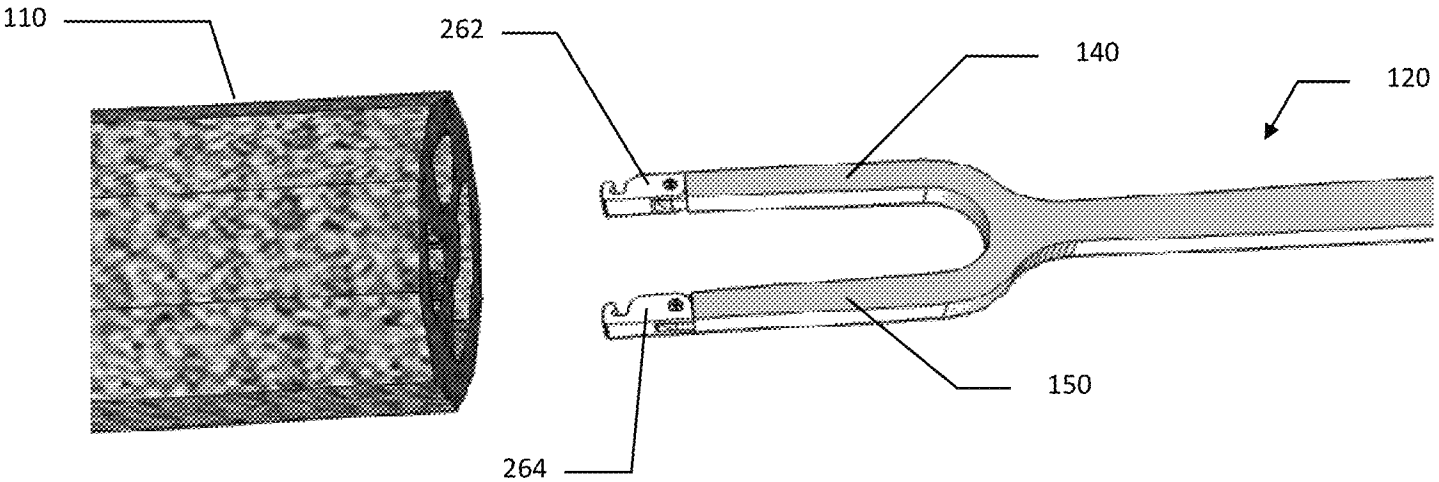
FIG. 22 is an isometric view of the holder of FIG. 18 being inserted into a cleaning head according to an embodiment of the specification.
Figure 23:
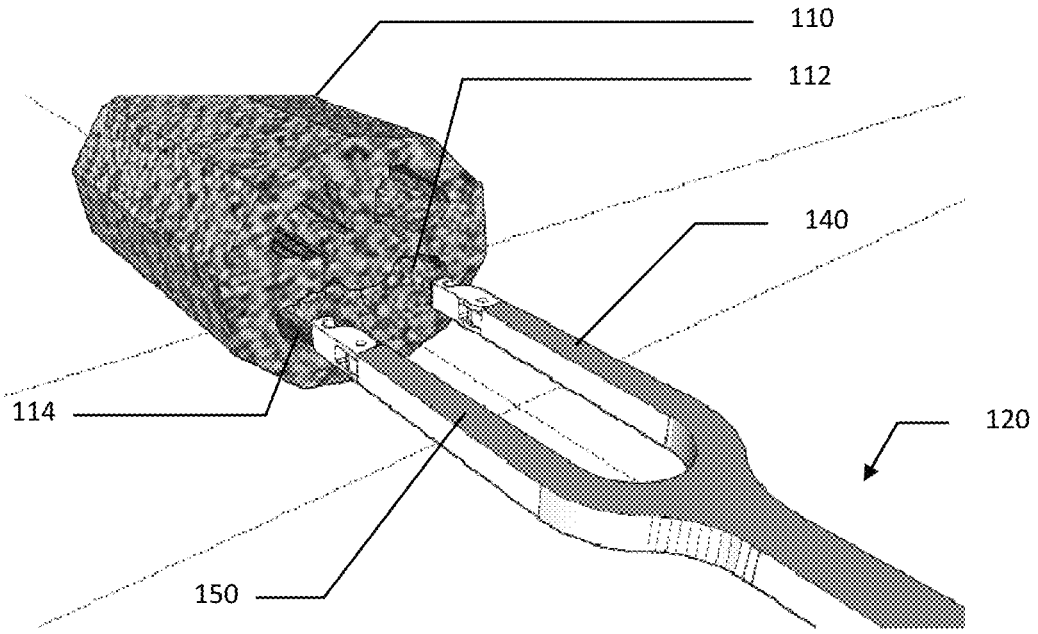
FIG. 23 is a perspective view of FIG. 22.
Figure 24:
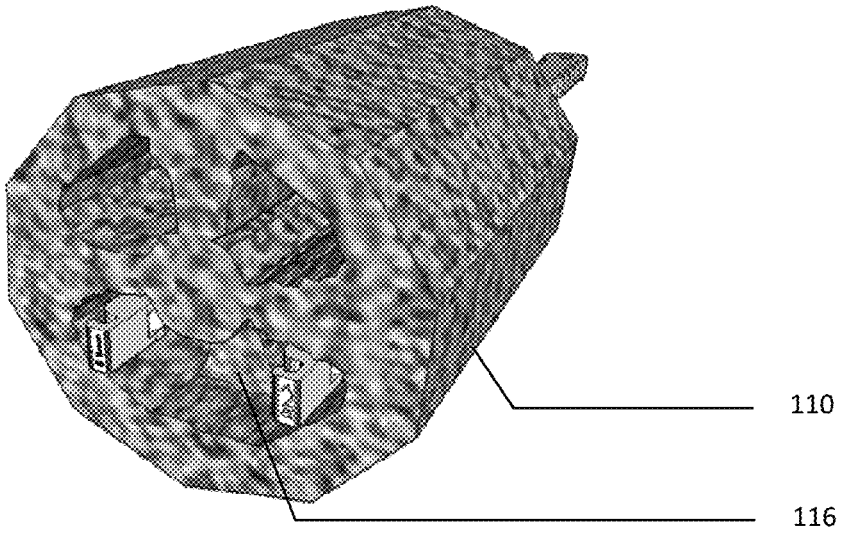
FIG. 24 is a perspective view of the holder of FIG. 18, after being inserted into the cleaning head, with the locking members in the unlocked position.
Figure 25:
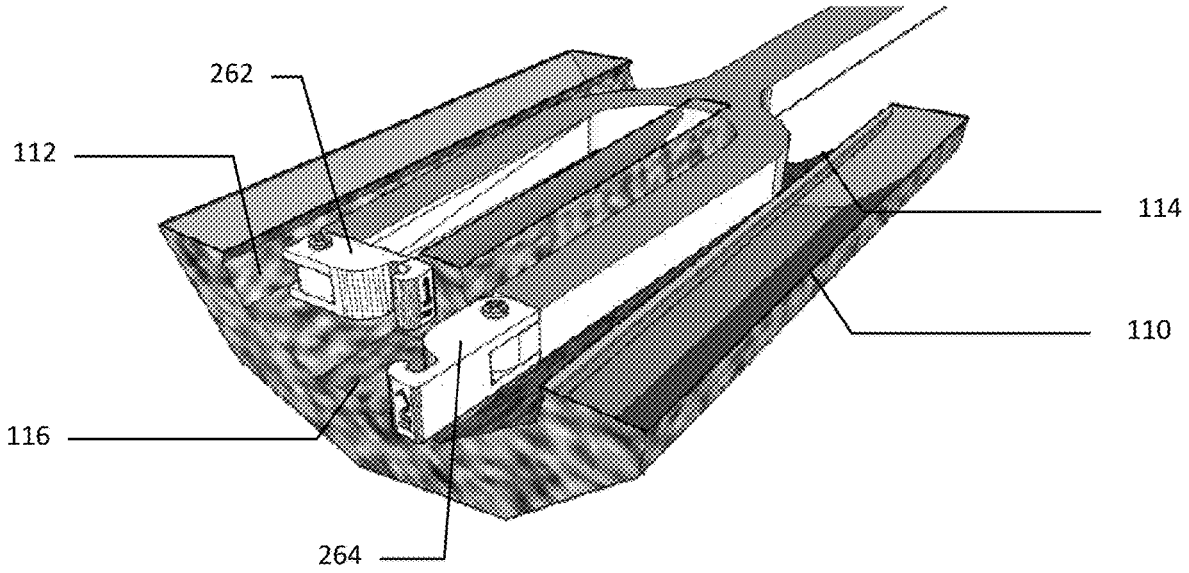
FIG. 25 is a sectional view of the holder of FIG. 18 inserted into a cleaning head, wherein the locking mechanism is in the process of moving to the locked position.
Figure 26:
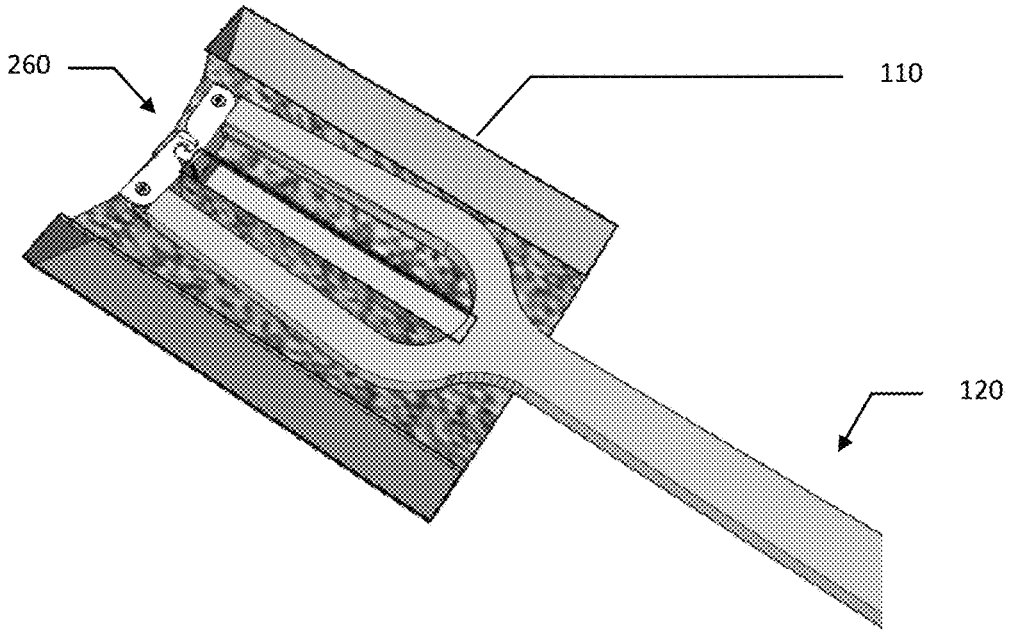
FIG. 26 is a sectional view of the cleaning implement of FIG. 16, in which the holder is fully inserted and the locking mechanism is in the locked position.
Figure 27:
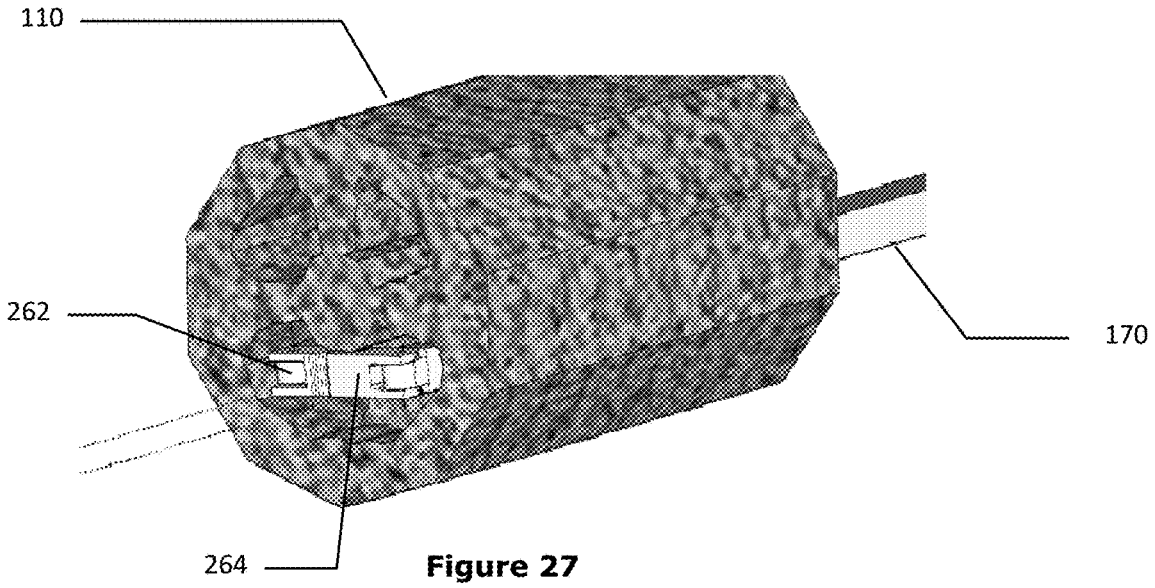
FIG. 27 is a perspective view of FIG. 26.
Figure 28:
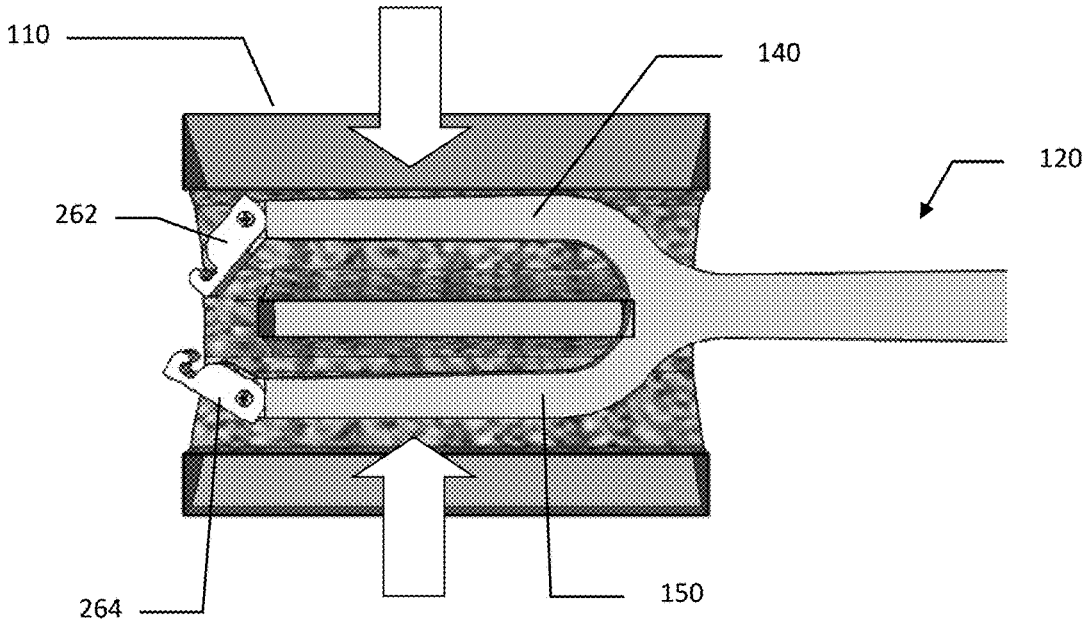
FIG. 28 is a sectional view of the cleaning implement of FIG. 16, wherein the locking members of the holder are being moved to the unlocked position.
Figure 29:
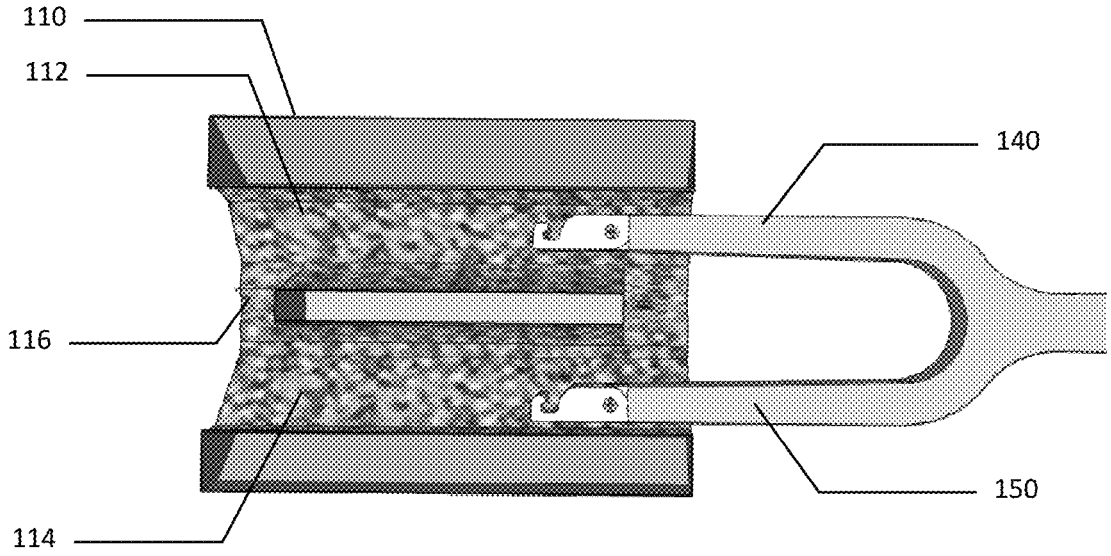
FIG. 29 is a sectional view of the cleaning implement of FIG. 16, in which the holder is being withdrawn from the cleaning head.

In the embodiment shown in FIGS. 18-21, the locking members 262, 264 have a complementary interlocking profile which allows the members 262, 264 to couple when in a locked position. FIG. 21 provides an enlarged view of the members 262, 264 entering the locked position. FIG. 26 provides a sectional view showing the members 262, 264 in the fully locked position.

As seen in FIG. 21, the members 262, 264 have matching hook-shaped profiles which snap into place when pressed into the locked position. The outside surface of the lug 262*a*, 264*a* on each member 262, 264 presses against a curved portion of the corresponding member 262, 264. This forces the lug 262*a*, 264*a* of each member into the corresponding recess 262*b*, 264*b* of the opposite member. The complementary nature of the lug 262*a*, 264*a* and the recess 262*b*, 264*b* maintains the connection until the process is reversed and the members 262, 264 enter an unlocked position. In some embodiments, the locking or unlocking process may be assisted by squeezing the arms 140, 150 toward one another (see: FIG. 20).

In some embodiments, one locking member 262 must be moved before the other locking member 264. For example, in FIG. 21, the first locking member 262 must be moved into position before the second locking member 264 can engage it. In that case, it may be useful to emboss the members 262, 264 with the numbers "1" or "2" to indicate the required sequence (See for e.g. FIGS. 24-25). In other embodiments, the locking members 262, 264 are designed to engage one another simultaneously.

Other interlocking configurations are also contemplated. For example, and without limitation, the members 262, 264 may have angular or ratchet-like profiles. Likewise, the members 262, 264 do not necessarily need to be identical, which may permit the use various snaps or the like.

Aside from the workings of the locking mechanism 260, described above, the cleaning implement 200 in FIGS. 19-29 may be inserted and removed from the cleaning head 110 in the manner described above for the cleaning implement 100 in FIGS. 1-14.

The specification also discloses a means for releasable attachment of a cleaning head 110 to a holder 120, in a cleaning implement 100, 200. The reusable nature of the holder 120 may in some applications reduce material costs and environmental impacts. The reliance of adhesives may also be greatly reduced, which may extend the life of the implement 100, 200.

The holder 120 may be constructed from various materials, including plastic, wood, bamboo, and light metal alloys. The locking members 162, 262, 264 may be constructed from the same, or different, materials than the arms 140, 150 of the holder 120. As discussed, the choice of cleaning head 110 will depend on the intended application for the cleaning implement 100, 200.

In applications where the implement 100 is a back scrubber, the cleaning head 110 can be replaced as needed (e.g. 3-4 weeks in the case of a loofah) without disposing of the holder 120. The user may also detach the cleaning head 110 for use in other aspects of bathing.

In applications where the cleaning head 110 is a loofah, it may be desirable to remove the loofah for drying between use, to increase exfoliation and prevent mold or bacterial growth. Loofah sponges from the species *Luffa aegyptica* may be particularly useful due to their loosely spaced fibers (when compared to other species) which allows the loofah to dry between baths without turning stiff and woody. In some embodiments, it may be, necessary to wet the loofah before the arms 140, 150 of the holder 120 can be squeezed to permit the locking mechanism 160, 260 to be moved into the locked position. A channel 116 may be particularly desirable to prevent the holder 120 from contacting the skin of the user, and may be formed by trimming the loofah accordingly. Likewise, the arms 140, 150 of the holder 120 may be sized to match the natural voids normally present in the fibrous skeleton of the loofah sponge, which may be used as the first and second apertures 112, 114. Adjacent or opposing voids may be used.

A holder 120 with arms 140, 150 that are about 4-6 cm apart and 10-15 cm long may be particularly suitable for use with a natural loofah sponge. In some embodiments, the arms 140, 150 can be adjusted to accommodate loofahs of varying lengths and diameter. In applications where the implement 100, 200 is intended for scrubbing one's own back, a handle 170 length of about 30 cm may be preferred.

Other applications for the invention are also contemplated, beyond bathing. For example, the implement 100, 200 maybe a barbeque brush, or a dish brush and the cleaning head 110 may be a disposable brush element. Likewise, the implement 100, 200 may be a duster and the cleaning head 110 may be a dusting head that is washable or disposable. Natural and artificial sponges or other scrubbing elements may also be used as the cleaning head 110, for pot scrubbers, bathroom sponges, dish sponges, and the like.

The embodiments of the present disclosure described above are intended to be examples only. The present disclosure may be embodied in, other specific forms. Alterations, modifications and variations to the disclosure may be made without departing from the intended scope of the present disclosure. While the system, devices and processes disclosed and shown herein may comprise a specific number of elements/components, the systems, devices and assemblies could be modified to include addition or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. All values and subranges within disclosed ranges are also disclosed. The subject matter described herein intends to cover and embrace all suitable changes in technology. All references mentioned are hereby incorporated by reference in their entirety.

The invention claimed is:

1. A bathing implement comprising:

a. a scrubbing head comprising a natural or synthetic loofah with a plurality of longitudinal apertures;

b. a resilient U-shaped holder with a first arm, a second arm, and an integral handle at the bottom of the U-shape wherein the said handle defines a cavity for storing and dispensing a cleaning liquid or gel and a locking arm to connect the two arms of the U-shaped holder to provide a closed frame to capture said scrubbing head, wherein respective ones of the plurality of longitudinal apertures of the loofah are configured to receive the first and second arms of the U-shaped holder, respectively;

c. said locking arm including a first end and a second end, wherein the first end of the locking arm is hingedly connected to the first arm of the said U-shaped holder and the second end of the said locking arm including a latch member configured to engage a catch member at the second arm of the said U-shaped holder;

d. wherein the locking arm includes a body with an open space along a length of the body configured in shape and size to accommodate a flat spring; and e. a flat spring with a first end and a second end wherein said first end of the flat spring is securely attached to the first arm of the U-shaped holder, and wherein a portion of the flat spring runs through said open space of the locking arm urging the locking arm in straight alignment with the first arm of the U-shaped holder thereby keeping the U-shaped holder in an open configuration.

2. The bathing implement as set forth in claim 1 wherein the said scrubbing head is configured to fit over the first and second arms of the said U-shaped holder when the locking arm is in an open position, like a glove over the fingers of a hand.

3. The bathing implement as set forth in claim 1, wherein the locking arm is configured to be turned over an angle of about 90 degrees and pushed down to latch with the second arm of the U-shaped holder, and wherein the second arm of the said U-shaped holder is configured to be pressed inward to facilitate latching with the locking arm thereby capturing the said scrubbing head.

4. The bathing implement as set forth in claim 3, wherein the bathing implement is configured to be used for scrubbing a bather's body, and particularly a back of the bather.

5. The bathing implement of claim 3, wherein the U-shaped holder is configured so that squeezing the first and second arms of the U-shaped holder towards each other will disengage the latch member of the locking arm from the catch member of the second arm of the U-shaped holder.

6. The bathing implement of claim 5, wherein the bathing implement is configured so that when the latch member is completely disengaged from the catch member, the flat spring causes the said locking arm to snap into an open position.

7. The bathing implement of claim 1, wherein the U-shaped holder includes at least one dispensing aperture in a wall of the U-shaped holder, and wherein the at least one dispensing aperture is in fluid communication with the handle cavity.

8. The bathing implement as set forth in claim 7, further comprising a dispenser within the handle cavity for dispensing a cleaning agent through the at least one dispensing aperture.

* * * * *